US008231287B2

(12) United States Patent
Burger et al.

(10) Patent No.: US 8,231,287 B2
(45) Date of Patent: Jul. 31, 2012

(54) VARIABLE SPEED PRINTING

(75) Inventors: Johan H. Burger, Vise (BE); Berend J. W. Waarsing, Venlo (NL); Ronald Fabel, Venlo (NL); Peter G. La Vos, Baarlo (NL); Frederik G. Heeman, Venlo (NL)

(73) Assignee: Oce-Technologies B.V., Venlo (NL)

( * ) Notice: Subject to any disclaimer, the term of this patent is extended or adjusted under 35 U.S.C. 154(b) by 435 days.

(21) Appl. No.: 11/785,690

(22) Filed: Apr. 19, 2007

(65) Prior Publication Data

US 2007/0248374 A1 Oct. 25, 2007

(30) Foreign Application Priority Data

Apr. 21, 2006 (NL) ..... 06112924

(51) Int. Cl.
*B41J 11/44* (2006.01)

(52) U.S. Cl. ..... 400/76; 400/582; 347/104; 399/75

(58) Field of Classification Search ..... 400/76
See application file for complete search history.

(56) References Cited

U.S. PATENT DOCUMENTS

| | | | | |
|---|---|---|---|---|
| 4,319,874 | A | 3/1982 | Sawano | |
| 4,560,293 | A * | 12/1985 | McCumber et al. | 400/76 |
| 4,833,626 | A * | 5/1989 | Malcolm | 358/1.8 |
| 4,970,557 | A | 11/1990 | Masuda et al. | |
| 5,185,627 | A * | 2/1993 | Hartman | 399/75 |
| 5,606,695 | A * | 2/1997 | Dworzecki | 705/8 |
| 5,714,990 | A * | 2/1998 | Courtney | 347/14 |
| 5,957,596 | A * | 9/1999 | Hastings et al. | 400/76 |
| 6,085,050 | A | 7/2000 | Rowe et al. | |
| 6,099,181 | A * | 8/2000 | Kitabatake | 400/76 |
| 6,106,176 | A * | 8/2000 | Yanagisawa et al. | 400/76 |
| 6,633,990 | B1 | 10/2003 | Eisenberg | |
| 6,768,884 | B1 | 7/2004 | Buchheit | |
| 7,412,185 | B2 | 8/2008 | Hall et al. | |
| 2004/0086289 | A1 | 5/2004 | Deguchi | |

FOREIGN PATENT DOCUMENTS

| | | | |
|---|---|---|---|
| EP | 0 952 727 | A2 | 10/1999 |
| JP | 59-64858 | A | 4/1984 |
| JP | 63-104067 | A | 5/1988 |
| JP | 63-267628 | A | 11/1988 |
| JP | 3-2769 | A | 1/1991 |
| JP | 9-114306 | A | 5/1997 |
| JP | 10-39719 | A | 2/1998 |
| JP | 10-186999 | A | 7/1998 |
| JP | 2001-105693 | A | 4/2001 |
| JP | 2002-2039 | A | 1/2002 |
| JP | 2002-287444 | A | 10/2002 |
| JP | 2006-23336 | A | 1/2006 |
| JP | 2006-76261 | A | 3/2006 |

* cited by examiner

*Primary Examiner* — Jill Culler
(74) *Attorney, Agent, or Firm* — Birch, Stewart, Kolasch & Birch, LLP

(57) ABSTRACT

An image reproduction device for document processing has a nominal processing speed at which it can process sheets continuously at a nominal document quality. However, the image reproduction device is arranged to process sheets at a continuously variable processing speed including the nominal processing speed. The actual processing speed is selected in dependence on operational conditions. In particular, the device is arranged to gradually adjust the processing speed from one processing speed to another processing speed. A control structure is given to select the variable processing speed in dependence on operational conditions, and to operate the image reproduction device at the selected processing speed. In a particular application of the variable speed, a print job may be started at an increased processing speed and then gradually fall back to the nominal speed, giving a fast start and a shorter processing time for short print jobs.

14 Claims, 9 Drawing Sheets

VARIABLE SPEED PRINTING

CROSS-REFERENCE TO RELATED APPLICATIONS

This nonprovisional application claims priority under 35 U.S.C. §119(a) on Patent Application No. 06112924, filed in the European Patent Office on Apr. 21, 2006, the entirety of which is incorporated herein by reference.

BACKGROUND OF THE INVENTION

1. Field of the Invention

The present invention relates to an image reproduction device for document processing. The device includes an input unit that provides sheets, a document conveying system that conveys the sheets from the input unit to an output unit to receive processed documents, a sheet processing system that applies an image pattern to a sheet while the sheet is being conveyed from the input unit to the output unit at a processing speed, and a control unit arranged to process the sheets at a nominal processing speed, at a nominal sheet distance and a nominal document quality, the image reproduction device is arranged to operate at the nominal processing speed continuously, and to process the sheets at a second processing speed, the second processing speed being different from the nominal processing speed while the sheets are processed at the nominal sheet distance and the nominal document quality.

The invention further relates to a method of controlling the image reproduction device for document processing. The method includes the steps of processing the sheets at a nominal processing speed, at a nominal sheet distance and a nominal document quality, the image reproduction device being arranged for operating at the nominal processing speed continuously, and processing the sheets at a second processing speed, the second processing speed being higher than the nominal processing speed while the sheets are processed at the nominal sheet distance and the nominal document quality.

2. Description of Background Art

An apparatus for copying documents and method of controlling document processing is known from U.S. Pat. No. 4,319,874. The apparatus includes a fuser for fixing toner images to copy substrates by passing the substrates between two pressure engaged fuser members, one of which is heated. A control for effecting movement of the members at two different speeds is provided such that the members are moved at the higher speed when a small number of copies are made and then at the lower speed when a large number of copies are being made. The control includes a temperature sensor for sensing the temperature of the heated member, which is used to generate a signal when the temperature of the member falls to a predetermined value, the signal being employed for changing the speed of the members from the higher speed to the lower speed.

In the known system, when the temperature sensor indicates the predetermined temperature has been reached, the speed is switched to a nominal operating speed at which the apparatus can be operated continuously for making a large number of copies. However, no further control of the internal operation of the apparatus is provided. Moreover, an instant switch to another processing speed can not be done while sheets are travelling through the system or the sheets will be torn or wrinkled due to the accelerations or decelerations taking place. Consequently, a speed change can only be done after emptying the sheet trajectories, whereafter the process can be restarted at the changed processing speed, which costs time and decreases productivity.

SUMMARY OF THE INVENTION

It is an object of the invention to provide an apparatus and method for flexibly and smoothly controlling an image reproduction device for executing processing jobs.

According to a first aspect of the invention, the object is achieved in that the image reproduction device is arranged to operate at a continuously variable processing speed in a range of processing speeds in which the documents are processed at the nominal sheet distance and the nominal document quality, which range includes the second processing speed, and in that the control unit is further arranged to select a processing speed in the range of processing speeds in dependence on operational conditions, and to operate the image reproduction device at the selected processing speed.

According to a second aspect of the invention, the object is achieved with a method as described in the opening paragraph, wherein further comprising the steps of operating the image reproduction device at a continuously variable processing speed in a range of processing speeds in which the documents are processed at the nominal sheet distance and the nominal document quality, which range includes the second processing speed; selecting a processing speed in the range of processing speeds in dependence on operational conditions, and operating the image reproduction device at the selected processing speed.

The measures have the following effect. The device is equipped to operate at the variable processing speed in the range of speeds, and is able to continuously change the processing speed, while operating, within the range. The processing system and conveying system are controllable to operate at various speeds, while maintaining the required nominal quality of the processed documents, e.g. the copies. Advantageously, a substantially continuous operational working range of speeds is achieved for accommodating various operational conditions.

The invention is also based on the following observations. From background art devices it may be known to temporarily reduce the effective processing speed by adjusting the distance between sheets in the conveying system, in particular increasing the average distance by skipping sheets at positions that have the nominal sheet distance and thereby creating effectively a reduced processing speed. The inventors have noted that such approach, while providing some relief for overstressed processing elements like a heated fuser unit, is highly inflexible. On the contrary, the inventors have identified a range of operational conditions where the need for reducing the processing speed may vary from only a slight reduction to a speed lower than half the nominal speed. Moreover, increasing the processing speed by shortening the distance between sheets is hardly possible, since generally, these distances are already as small as possible to optimize productivity.

By continuously adjusting the speed to the operational conditions, a high efficiency is achieved of the available document processing elements in the device. Furthermore, background art devices are known that have an increased speed mode producing documents at a reduced quality. The current invention provides controlling the speeds in the range without affecting the quality. Advantageously, the user is not bothered with selecting or accepting processed documents of different quality, while providing an optimal speed of processing in view of the operational conditions.

In an embodiment of the device, the processing speed is gradually adjusted from one processing speed to another processing speed. This has the advantage that mechanical shocks are prevented, and noise and wear of the device and the sheets are reduced. A sudden speed increase would most probably damage the sheets that are being transported in the device, so that in fact, the only safe way to change the speed is to first empty the sheet conveying system, which would obviously lower the productivity.

In an embodiment of the device, the control unit is arranged to select a processing speed that is higher than the nominal processing speed, in dependence on first operational conditions. Advantageously, this would at least partly compensate a lower productivity occurring in the starting phase of a processing job. Another advantageous application of a higher processing speed is for processing a high priority job that interrupts a running job.

In a further embodiment of the invention, the device is arranged to maintain a selected processing speed higher than the nominal processing speed for a time period selected in dependence on the operational conditions.

This has the advantage that the mechanical load and temperature stress by the temporary speed change are limited, so that the device can keep operating properly.

In another embodiment of the invention, the control unit is arranged to select a processing speed that is lower than the nominal processing speed, in dependence on second operational conditions. Such operational conditions would, e.g. comprise an operational parameter, such as fuser temperature or available energy supply.

In particular, the gradual lowering of the variable processing speed accommodates a number of operational conditions, such as a graceful degradation in dependence on adverse operational conditions or a selected or detected noise production. Furthermore, a range of different types of sheets may be accommodated, and a selected or detected operational mode may benefit from the variable processing speed. Also, a selected or detected performance parameter may be used to variably adjust the processing speed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
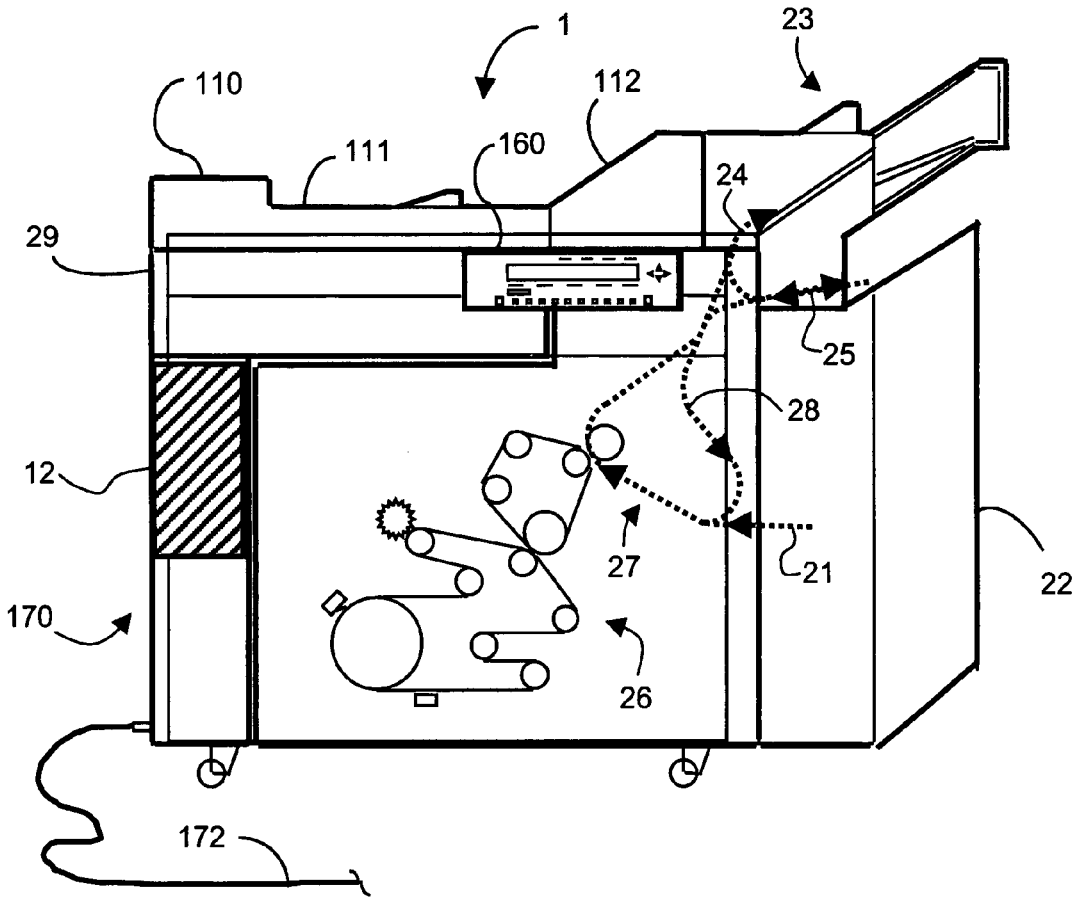
FIG. 1 shows a digital image reproduction device.

The Figures are diagrammatic and not drawn to scale. In the Figures, elements that correspond to elements already described have the same reference numerals.

FIG. 1 shows a digital image reproduction device 1, on which the different parts are separately shown in diagram form. The documents to be processed are usually paper sheets, but may also include any other type of sheets for carrying information, e.g. overhead sheets, etc. The device has an input unit 22 for providing sheets, which may have several trays containing sheets to be processed, and an output unit 23 for receiving processed documents. The output unit 23 may include an output tray, or may be a finisher including sorting, stapling, and further processing of printed sheets.

The device has a printing system 26 which may include an electro-photographic processing section known per se, in which a photoconductive medium is charged, exposed via an LED array in accordance with digital image data, and is developed with toner powder. Thereafter, the toner image is transferred and fixed on an image support, usually a sheet of paper, while the sheet is being conveyed from the input unit to the output unit at a processing speed.

The device has a document conveying system 27 for conveying the sheets from an input trajectory 21 at the input unit to an output trajectory 24 at the output unit 23, along printing system 26. The sheet conveying system includes a turning section 25 for turning sheets, and a duplex return trajectory 28, for duplex treatment and/or finisher operations. As such, the printing system 26 and the conveying system 27 having various motors, rollers, guidance elements, belts, etc. are well known in the art of printing devices.

The device also includes a control section, shown diagrammatically by reference 170, and explained in more detail later. A cable 172 may connect the control section 170 via a network interface to a local network. The network may be wired, but may also be partly or completely wireless. The control section 170 includes a control unit 12 arranged for controlling the sheet conveying system 27 and printing system 26. According to the invention, the control unit is arranged for controlling the speed of conveying and processing at a variable rate as discussed below in detail.

The device has a user interface 160, for example including an operator control panel provided on the apparatus for operation thereof. The user interface may be provided with a display and keys.

The digital image reproduction device may be a printer only, but preferably is a multi-functional device further including scanning, copying or faxing functions, e.g. a versatile copier. A document feeder 110 is provided with an input tray 111 for the introduction of a stack of documents, a transport mechanism (not shown) for transporting the documents one by one along a scanner unit 29 to a tray 112, in which the documents are placed after scanning. The scanner unit 29 includes a flat bed scanner provided with a glass platen on which an original document can be placed, a CCD array and an imaging unit having a movable mirror and lens system for imaging the document on the CCD array. In these conditions, the CCD array generates electrical signals that are converted into digital image data in a manner known per se.

The control unit 12 may be arranged for detecting a scan job in the processing job and executing the scan job by scanning a physical document entered in the input tray 111, and for storing the image file generated in the scanning under the name of the user who activated the processing job. It is noted that the control unit may detect the presence of documents to be scanned and subsequently automatically start a scan job.

The device is arranged for processing the sheets at a nominal processing speed, i.e. the control unit and mechanical elements have been designed for operating at the nominal processing speed continuously (e.g., for large processing jobs). During the continuous operation, the sheets are conveyed along the various processing units at a nominal sheet distance, i.e. the sheets are entering, and are subsequently transported along, the paper path at regular distances. It is noted that some known devices achieve a reduced throughput speed by omitting sheets at certain predefined instants, usually called skipping mode. However, in such mode the engine speed, i.e. the transport speed through the conveying system, remains unchanged. Finally, it is noted that, in the nominal speed mode, the sheets are also processed at a nominal document quality, e.g. a selected printing quality. It is noted that some known devices achieve a reduced quality at a higher speed. The present invention relates to delivering sheets processed at a predefined, nominal quality level, in spite of varying the document processing speed as discussed below.

For varying the document processing speed, the control unit 12 controls the conveying system and the processing elements to transport and process the sheets at a second processing speed. The second processing speed is different from the nominal processing speed while the sheets are processed at the nominal sheet distance and the nominal document quality. Moreover, the second speed may be reached in a gradual way. The processing speed may be increased temporarily, e.g. for processing a relatively small job, and may be gradually reduced to the nominal speed during a larger job. In particular, the image reproduction device is arranged for operating at a variable processing speed in a range of processing speeds. Hence, the second speed may take any of a large number of different values. At each speed in the range, the documents are processed at the nominal sheet distance and the nominal document quality. Although the present invention is in the first place intended for printing (black only, or color), various other types of processing may be applied to the sheets, such as other surface treatments like applying a cover layer. The processing may also include scanning original sheets, two sided (duplex) treatments, and finishing steps like sorting or stapling.

The elements for document processing are adapted to be operated at the varying speed. Such elements include a digital imaging unit, which is arranged for applying the image pattern based on digital document data at the variable processing speed. Furthermore, the control unit 12 is arranged for selecting the variable processing speed in the range of processing speeds in dependence on operational conditions, and operating the image reproduction device at the variable processing speed as selected. Examples of such operational conditions are discussed below.

Figure 2:
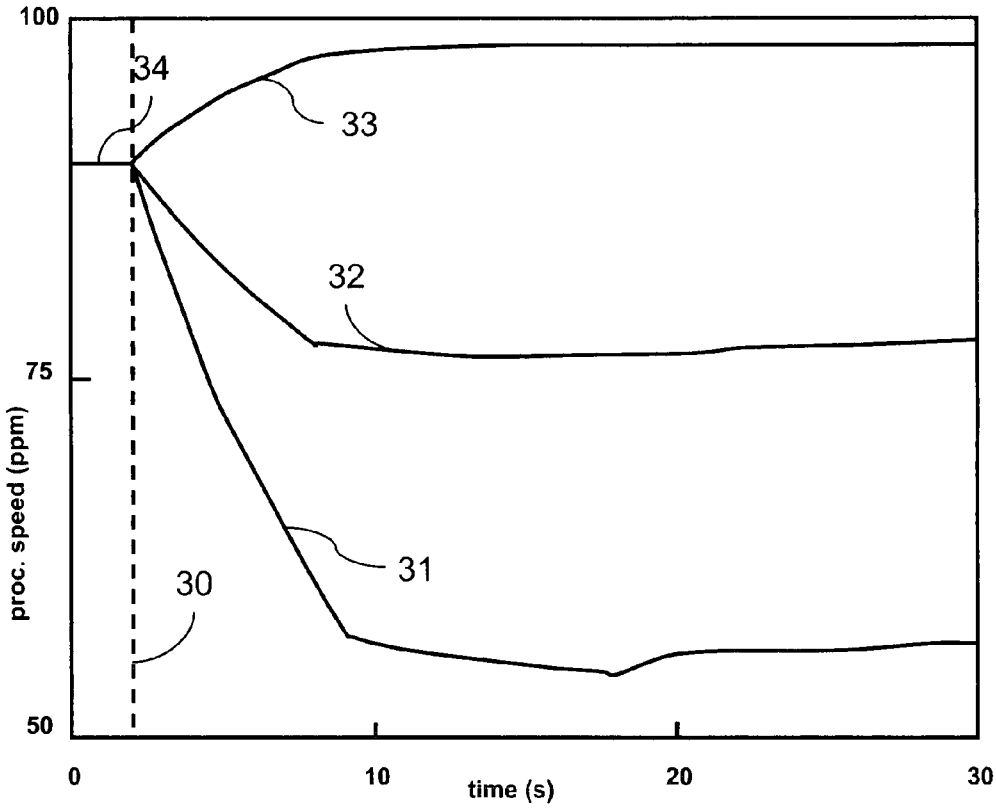
FIG. 2 shows gradually adjusting the processing speed to operational conditions.

FIG. 2 shows gradually adjusting the processing speed of an exemplary printing engine in response to various operational conditions, for example measured with a sensor like a temperature sensor for an operational temperature of processing elements or for environmental temperature, or established by a setting defining operational requirements like job processing time, printing quality, a timing schedule like a special treatment for high priority jobs, etc.

In FIG. 2 the processing speed of the engine in pages per minute (ppm) is given along the vertical axis, while the horizontal axis defines time in seconds. A dotted line 30 indicates the start of a printing job. At the start of the job, a nominal speed (34) is initially set.

Now, thin paper has a low heat coefficient and therefore, relatively little heat energy is removed from the fusing system, while thick paper takes more energy for fusing toner on it. Accordingly, given a maximum heat production in the fuser, thin paper may be processed at a higher speed than thick paper.

For example, for curve 33, a relatively thin type of paper sheet (80 g/m$^2$) has been used. The paper type to be processed may be detected by a sensor, or may be known, e.g. from selection of a specific paper input unit. The sheet type may also be detected indirectly, e.g. by detecting a temperature in a temperature controlled processing step like a pre-heater element or fusing element along the paper path. In response to this situation, the control unit decides that a higher processing speed is possible and therefore gradually increases the processing speed until a new equilibrium speed has been reached as is shown in the upper curve 33 of FIG. 2.

A middle curve 32 indicates gradually decreasing the processing speed. A thicker type of paper sheet (120 g/m$^2$) has been used. A lower curve 31 indicates gradually decreasing the processing speed to a substantially lower continuous rate, due to a heavy type of paper sheet (200 g/m$^2$). It is noted that the processing speed is gradually adjusted from the nominal processing speed, at the starting point 30, to the variable processing speed. In different situations, the speed is adjusted from the variable processing speed to the nominal, or any other, processing speed, as discussed below.

Figure 3:
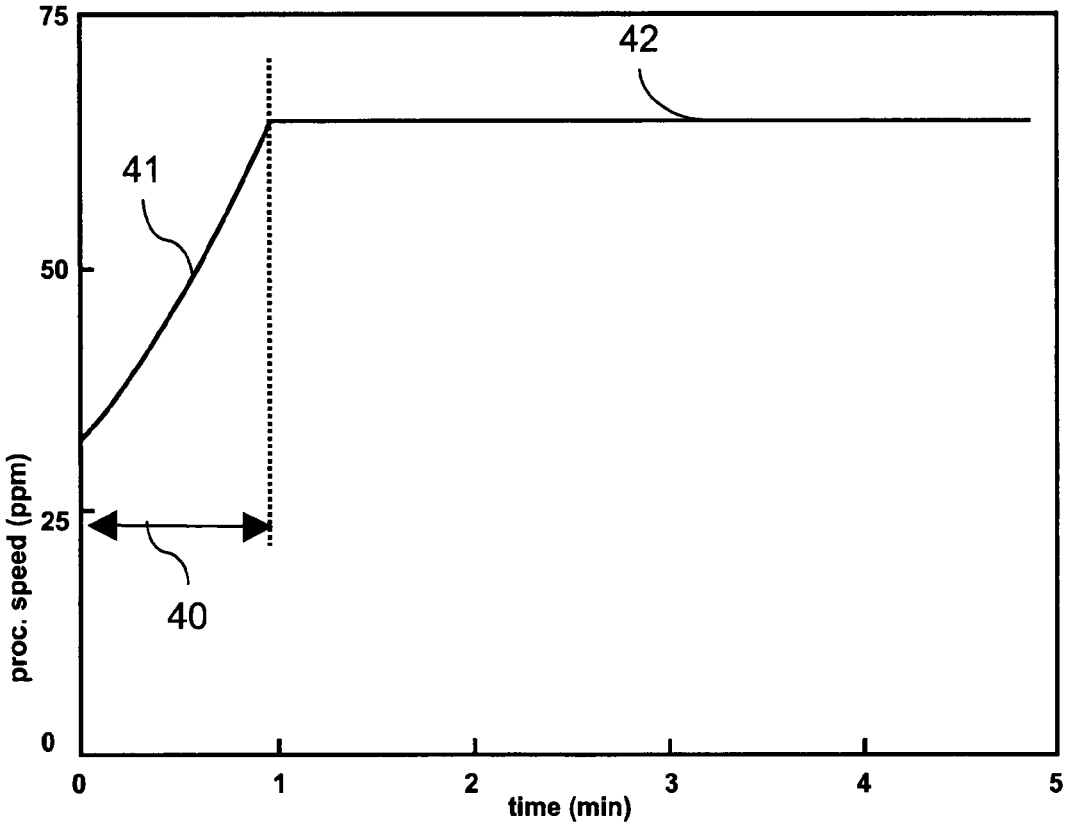
FIG. 3 shows adjusting the processing speed in a time period.

FIG. 3 shows another use of a continuously variable processing speed. If some elements of the engine need time to be prepared for operating at full speed, it may nevertheless be possible to start a printing process at a decreased speed before all elements have reached their nominal operating conditions. For example, for reducing power consumption in standby, some elements, in particular the fuser system, may not be continuously kept at their nominal operational temperature. However, while the fuser is heating up, before it reaches its nominal operational temperature, it arrives at a temperature at which it can operate at lower speed, even though this temperature does not yet allow operation at the normal speed. At this point, the print process may already begin at the lower speed. Then, while the temperature rises further, the processing speed may gradually be increased to the nominal speed. Obviously, this results in an earlier start, and therefore in a shorter waiting time for the first sheet to be completed and to appear at the output device.

In FIG. 3, the processing speed of the engine in pages per minute (ppm) is given along the vertical axis, while the horizontal axis defines time in minutes. FIG. 3 shows that the printing speed at the start of the job (time=0) is reduced, and is gradually increased during an initial period 40, while the element is still in the process of heating up, as indicated by curve 41. Subsequently, the job is processed at a nominal speed as indicated by curve 42. Obviously, the effect of faster completion that results from this strategy is more noticeable for short jobs.

In another embodiment of the present invention, the processing speed may be temporarily increased at the start of a print job, as long as the further processing elements are able to comply with the increased speed due to operating tolerances. For instance, the printing system 26 may be able to operate at a range of processing speeds and may further be adapted to accommodate speed variations without losing image quality. In fact, many printing systems are relatively tolerant or can be adapted so. Thus, at least the first few sheets of a job may be processed at an increased speed by adapting the system to allow such speed. Obviously, short jobs will benefit most clearly from a temporary speed increase, since they may be finished before the processing speed is brought back to the nominal value.

Figure 4:
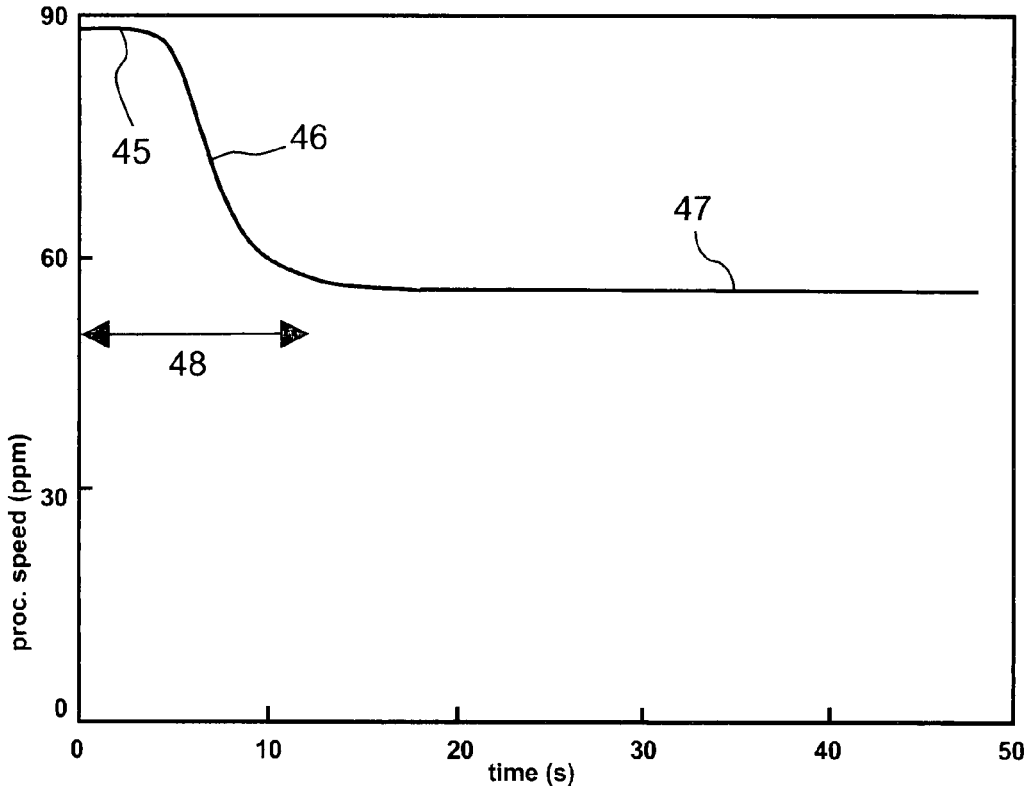
FIG. 4 shows another form of adjusting the processing speed in a time period.

FIG. 4 shows a graph of the processing speed of the engine in prints per minute (ppm) against time in seconds, for a process wherein a temporary processing speed increase as described above is implemented. As shown, the print process is started at an increased processing speed (part 45 of the curve), but then the speed is lowered gradually (part 46 of the curve) until the nominal processing speed is reached and is kept to the nominal speed for the rest of the process (part 47). The processing at increased speed may be controlled in accordance with a predetermined strategy, such as a predetermined or calculated time period or a predetermined or calculated number of prints (pages), or in accordance with the device condition, such as fuser temperature. The temporary speed increase can be used to advantage in several applications, some of which will be described below.

In a first application, use is made of the stored heat in the fuser, to attain faster processing of small jobs. The increased speed is maintained as long as the temperature decrease of the fuser due to the increased speed remains within the operating tolerances. During the period 48, wherein the processing speed is higher than the nominal speed, the fuser cools down, since more heat is required than the internal heater of the fuser can generate. However, period 48 is chosen so as to end before the fuser reaches its lowest acceptable temperature, and printing is not disturbed by a malfunction call. A small job may be entirely processed in the period 48 or even in period 45, and thus will benefit greatly from the increased speed.

In a second application, the temporary speed increase at the start of a job is purposely used to increase productivity of a printer device up to its nominal value. In this connection, productivity is defined as the number of prints of a job, divided by the time necessary for printing those prints, with the number of prints (job size) being a parameter.

When a processing job starts, even if the engine is fully operable (e.g., the fuser is at working temperature), the time that the first sheets need to travel through the device, is "dead" time, as no prints appear at the output unit yet. After the first sheet has reached the output unit, sheets keep coming out at the rated productivity as specified in prints per minute (ppm). Accordingly, the time needed for completing a processing job is always longer than the number of prints divided by the ppm specification. Especially, small jobs suffer from a lower than specified productivity, since the "dead" time is a substantial part of total processing time. By increasing the processing speed during the first few prints and then gradually decreasing the processing speed to the nominal one, the loss of productivity may at least be partially compensated. As explained above, the number of prints produced at increased speed is limited to the temperature latency of the fuser, but if the fuser can handle it, the increased speed period may be so calculated as to reach the nominal productivity. Thereafter, the speed is brought back to the nominal value, thereby assuring the rated productivity.

Figure 5:
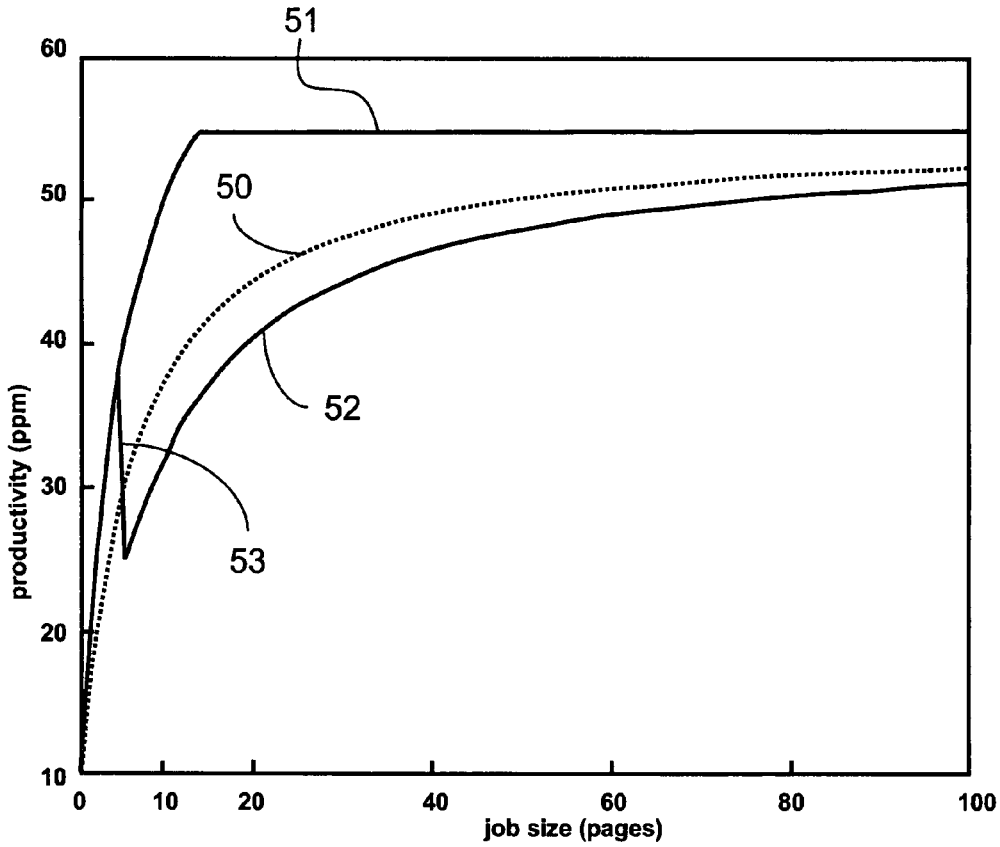
FIG. 5 shows batch speed using a fast start.

As an example, FIG. 5 shows the effect of a fast start on productivity. In FIG. 5, the productivity of an exemplary engine in pages per minute (ppm) is given along the vertical axis, while the horizontal axis defines job size.

As mentioned above, the control unit 12 is arranged for selecting an increased processing speed in dependence on operational conditions. FIG. 5 shows, as a dotted curve 50, the average productivity for a job while operating at nominal speed of 55 ppm. An upper curve 51 shows applying an increased speed during a limited period at the start of a job, showing that the rated speed is attained for much smaller jobs. As soon as a nominal productivity is reached (in the example for batches just over 10 pages), the increased speed is gradually readjusted to the nominal speed of 55 ppm.

The lower curve 52 shows a situation for a print engine that cannot change processing speed gradually, but instead must first empty its sheet conveying system, then change over to the nominal speed, and then restart processing. The downward part 53 of curve 52 corresponds to the speed change period. It is clear that for such engines, starting at a higher speed and then falling back to the nominal processing speed is no option, since even though productivity may be higher for very small jobs, it falls back to lower than that of a single-speed engine (curve 50) if the job proves to be larger.

In a further embodiment of the apparatus, the job size is first detected. Subsequently, for jobs exceeding a predetermined size, a variable period and amount of increase of the processing speed is set in dependence on the detected job size. For example, for a longer job there may be a slightly higher speed, but for a longer period, while short jobs are initially processed at a substantially higher speed for a short period. As a result, jobs of various sizes are performed at a required, fixed productivity level.

In yet another application of the fast start, the device may be adapted to be used in combination with a finisher that has an allowable input frequency (pages per minute) that is lower than the processing speed of the engine. In that case, the engine may be initially operated at a high speed exceeding the maximum finisher speed until the first sheet reaches the finisher, the subsequent sheet being delivered at the finisher with a reduced speed that can be handled by the finisher.

It is noted that the gradual and/or temporary adjusting of the variable processing speed accommodates a number of operational conditions, such as a graceful degradation in dependence on adverse operational conditions, like a limitation of the power supply that is available. Such power level may be detected by a sensor, or a power need may be estimated by calculation in the control unit. An operator may select a lower power mode for the apparatus, and by varying the operational speed the device can smoothly match the requirements. Also, a level of noise produced by the apparatus may be controlled. A noise production level may be selected (or detected by a sensor). The noise level may be controlled by reducing the speed, e.g. during working hours, and possibly increasing the speed in other periods. Furthermore, a range of different types of sheets may be applied, and a selected or detected operational mode may benefit from the variable processing speed. Also, a selected or detected performance parameter or test condition may be used to variably adjust the processing speed.

In an embodiment, selecting the increased processing speed may be applied as follows. A high priority job may be detected, and an increased speed may be temporarily set for that job only. Also, an interrupt job that has to be processed while an earlier job is still being processed, may be detected and processed at higher speed.

The interrupting processing job may be executed at an increased processing speed, and subsequently the further processing job is to be resumed at the normal speed. The interrupt processing may also be performed at higher speed in an interleaved mode with the further processing job, e.g. alternatingly printing pages (or small groups of pages) and guiding the pages to respective delivery units.

The apparatus may be provided with a status indicator on the user interface panel 160 for indicating a processing speed status.

In an embodiment, the varying processing speed is controlled in dependence on a specific processing mode of the apparatus, for example a high quality mode, or a duplex printing mode. The processing speed is adjusted in dependence on the processing mode. For duplex printing (in a single-sided printing unit), an output unit such as a finisher receives the sheets after they have been processed twice. Hence, the processing speed of the respective elements of the apparatus may be increased without exceeding the maximum speed of the finisher, provided that the timing of the delivery of duplex sheets is at regular intervals. In this way, a relatively slow finisher may still be employed in combination with a much faster printer engine. Ultimately, the increased processing speed may be set to double the maximum sheet receiving speed of the output unit.

In an embodiment, the control unit 12 is arranged for selecting a reduced processing speed in the range of processing speeds in dependence on operational conditions of the digital image reproduction device. Examples thereof include selecting the reduced processing speed in dependence on detecting a temperature in one or more of the processing steps, detecting a temperature in the environment inside or outside the housing of the device, detecting a power consumption of the image reproduction device, detecting a start up condition of the image reproduction device, or detecting a maintenance condition or performance parameter. For example, a lower speed may be set when a maintenance action is overdue. A performance parameter, e.g. when it is detected that a toner level is low, may be used to adapt the speed to maintain a required quality.

In an embodiment, where the device has an output unit 150 for delivering processed documents, the control unit 12 is arranged for detecting a finishing parameter of the output unit, such as a finishing speed or mode. By detecting the predefined or actual values of such finishing parameters, the operation of the document processing may be adapted to the options of the finisher unit. Hence, the processing speed is adjusted in dependence on the finishing parameter. In particular, as already described above, the apparatus may be initially operated at a high speed exceeding the maximum finisher speed until the first sheet reaches the finisher. The subsequent sheet is delivered at the finisher with a reduced speed that can be handled by the finisher.

In an embodiment, where the device has a scanner unit 29, the control unit 12 is arranged for executing a scan job at a scan speed in dependence on the variable processing speed. In general, the scanning speed may be independent of the processing speed. However, the scanning speed may be adjusted to match the processing speed, e.g. for reducing the noise level produced or adapting the power consumption.

Figure 6:
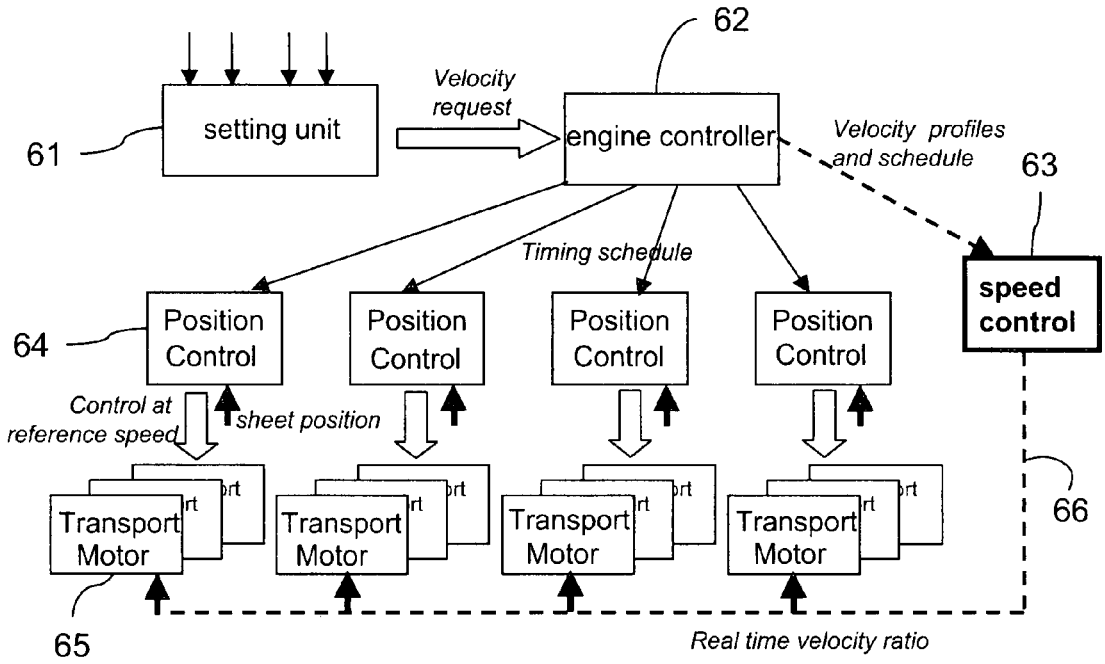
FIG. 6 shows a control structure for a digital image reproduction device.

FIG. 6 shows a control structure for a digital image reproduction device that enables gradual process speed variations in accordance with the present invention.

In FIG. 6, an engine controller 62, which forms part of the control unit 12, controls the actions and allocates the actions to various position control units 64 according to commands providing a timing schedule. The engine controller is based on a controller disclosed in U.S. Pat. No. 6,633,990 of Océ-Technologies B.V., which is incorporated herein by reference.

The position control units 64 each control one or more elements 65 in the processing device, such as transport motors, imaging units, heaters, etc. Each position control unit 64 has local control over a part of the total processing path, e.g. part of the conveying system constituting a part of the paper path. A number of measurements is received at setting unit 61, which may further include a calculation unit for performing algorithms to derive required information about operations conditions and parameters of the sheet processing. According to the operations parameters, a speed request is transferred to the engine controller 62, which communicates velocity profiles and schedules to the position control units 64 and to a speed control unit 63, which sets a speed for each element 65, e.g. a ratio with respect to a reference speed of the respective element, as will be explained below.

An example of a variable speed control according to the present invention will now be described.

The velocity at which sheets pass the marking area for generating the image is continuously variable. The speed set point and changes are planned in setting unit 61 based on algorithms, which may be driven by measurements like energy consumption, job status, print quality, multi-user behavior, etc. Evaluation of these measurements results in speed variation, which is then planned and executed via engine controller 62 and speed control unit 63. The engine controller 62 is responsible for planning the transport of each sheet and image through the copier/printer. The planning process results in 'feed forward' time targets (as disclosed in detail in U.S. Pat. No. 6,633,990) which are executed in real-time by distributed position control units 64, called position control. Since sheet position is measured, the position control software is independent of the base speed. The distributed position control units 64 control the transport motors assuming a reference speed. The speed modulation is planned by the engine controller 62 and executed by the speed control unit 63, which executes the velocity profiles by invoking a speed ratio (with respect to the reference speed) directly in real-time to the transport motors in the system.

It is noted that the engine controller 62 may be implemented as a distributed system to support modularity, or may include the speed control unit 63 and/or the setting unit 61. Furthermore, the speed control unit 63 also controls the speed of writing of image lines by a digital imaging unit, in addition to controlling the transport motors. Real-time low level manipulation of motor speed differs in implementation for different motor types, e.g. 'stepper motors' require step manipulation, while other motors require set point manipulation.

Figure 7:
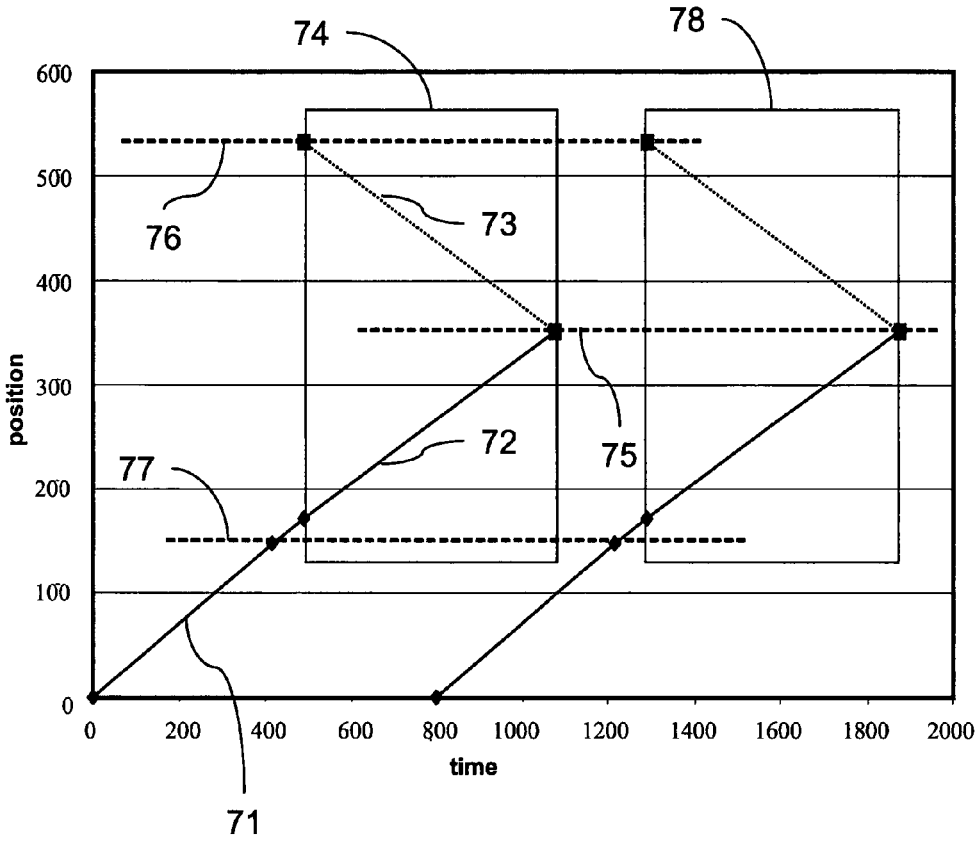
FIG. 7 shows a position and time diagram for a sheet and an image pattern.

FIG. 7 shows a position and time diagram for a sheet and an image pattern. As is well-known in the printing art, a toner image may be formed in the image forming system 26 under digital control, and then transferred and fused onto an image carrier sheet that has been supplied from sheet input unit 22. Thus, the timings of the sheet input and the image formation must be coordinated accurately. The example of FIG. 7 is given for a simple case in which no speed change is implemented.

The vertical axis in FIG. 7 indicates position, and the horizontal axis indicates time, both in arbitrary units. In FIG. 7, line 71 indicates the trajectory of a first sheet from a stopper pinch position at coordinates (0;0), via a fine positioning location (X-fine) indicated by a first horizontal dashed line 77, to a fuse position (where the toner image and the image carrier sheet are united), indicated by a second horizontal dashed line 75. A second line 73 indicates the trajectory of a first image pattern from a start of picture (SOP) position indicated by a third horizontal dashed line 76, to the fuse position on line 75. In the Figure, the area in which the second line 73 of the image pattern, and a part 72 of the sheet trajectory, proceed to the fuse position, indicated by rectangle 74, indicates an area of control where the sheet and the image pattern are controlled by one control device, e.g. one same motor. A next rectangle indicates a second sheet and image pattern arriving at the fuse position. In the rectangles, also during speed changes, the profiles of movement along the trajectories are coordinated, and therefore the processed sheet or the image will not be damaged due to speed mismatch. As will be understood, accurate scheduling of control timing, in particular determining synchronization signals, is required during speed changes.

Figure 8:
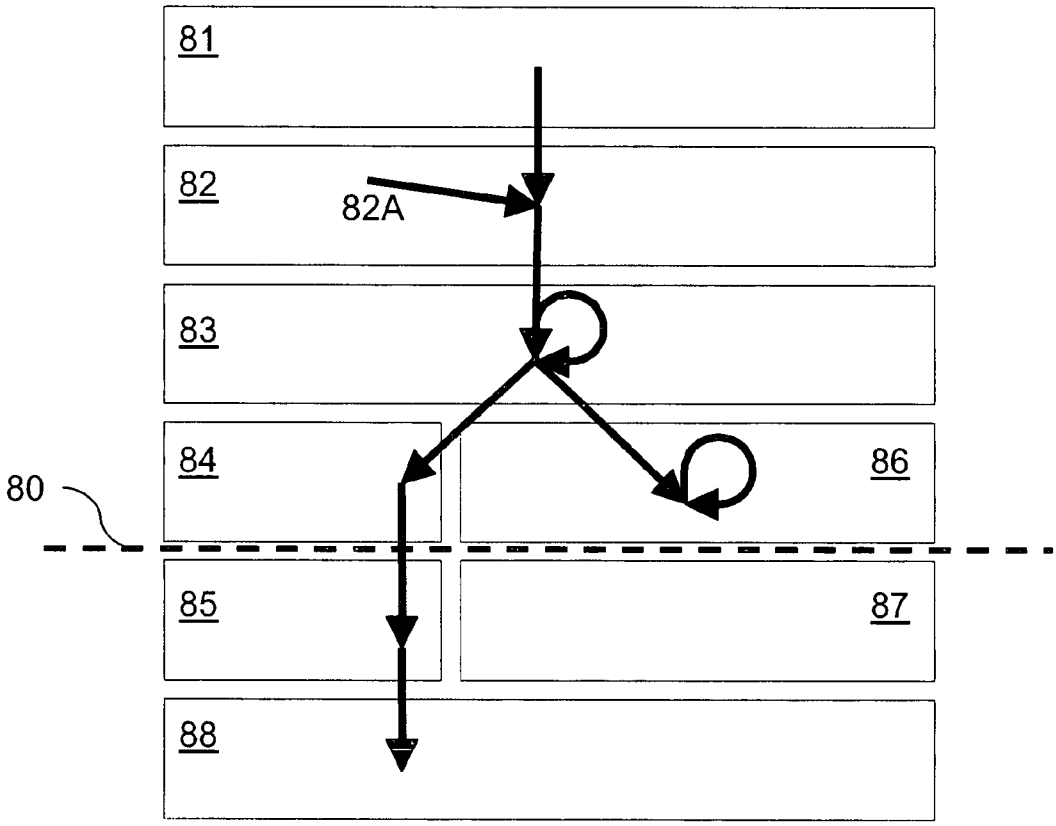
FIG. 8 shows a process for adjusting the processing speed.

FIG. 8 shows an exemplary process for adjusting the processing speed. The steps above dashed line 80 are performed at a main control node (the engine controller 62), whereas the actual speed control, below dashed line 80, is further executed in a distributed set of sub-nodes (the speed control unit 63 and the position control units 64). The first step 81 indicates a controller step where the engine is informed that a speed change is required for an external reason, such as, e.g., start of an interleave job. At next step 82 a speed setting step plans the speed change moment. This may also be triggered by an internal cause for speed change 82A (like temperature sensor signals). At next step 83 synchronization times are (re-)calculated, and speed setting commands are generated to inform sub-nodes of the speed changes at control steps 84. Further procedural steps 86 may also receive updated sync times and speed change information. Such further procedural steps may use the updated sync times for recalculating internal schedules and deriving further sync times. Some lower control level steps 87 may be robust to speed changes, whereas other lower control level steps 85 actually take care of the speed change for the motors of the sheet conveying system 88.

Figure 9:
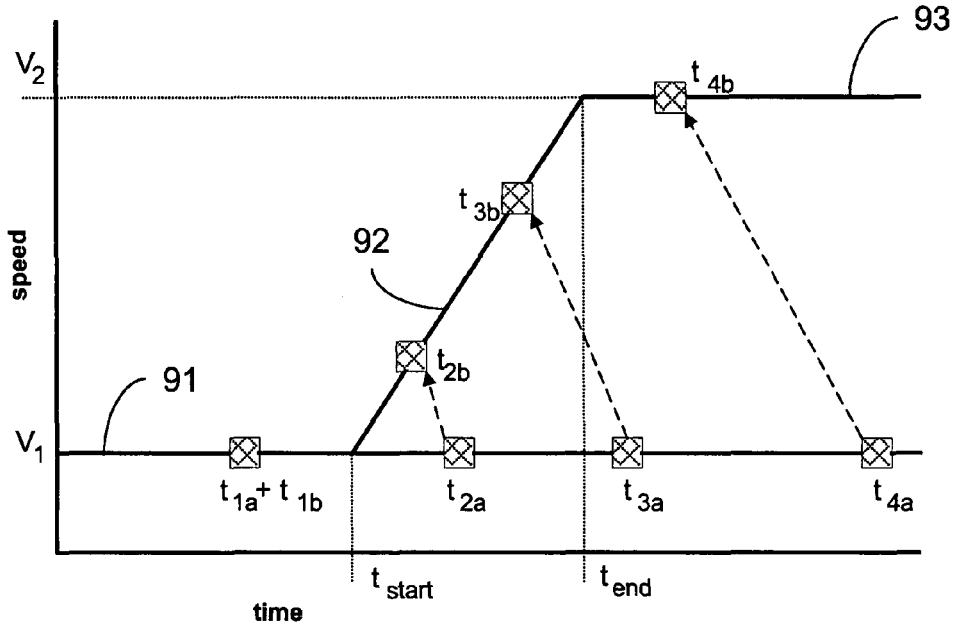
FIG. 9 shows calculation of synchronization times.

FIG. 9 shows calculation of synchronization times. Synchronization times are times whereat a coordinated action must take place, such as, e.g., a sheet conveying section taking over a sheet from its preceding sheet conveying section.

In FIG. 9, the vertical axis indicates speed, and the horizontal axis indicates time. In the Figure, a first horizontal line 91 indicates the trajectory of a sheet, which may continue horizontally without speed change as line 94. Four synchronization times are given for the case without speed change ($t_{1a}$, $t_{2a}$, $t_{3a}$, $t_{4a}$). Alternatively, in sloping line 92, a speed change is performed from speed $V_2$ at $t_{start}$ to higher speed $V_2$ at $t_{end}$, after which the trajectory continues at speed $V_2$ in line 93. The recalculation of three synchronization times ($t_{2b}$, $t_{3b}$, $t_{4b}$) is illustrated for the case with speed change. FIG. 9 shows a speed profile due to a speed change. From the speed profile, the new synchronization times are calculated based on the position of the respective sheets due to the actual speed.

Although the invention has been mainly explained by large printing devices for a company environment, it is to be noted that the variable speed control is also suitable for document processing on a different scale, such as a small scale printer, multifunction devices or special printing devices like industrial wide format printers.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image reproduction device for document processing, said image processing device comprising:

an input unit that provides sheets;

a document conveying system that conveys the sheets from the input unit to an output unit to receive processed documents;

a sheet processing system that applies an image pattern to a sheet while the sheet is being conveyed from the input unit, past the sheet processing system, to the output unit at a processing speed, wherein the sheet processing system and all processing elements of the document conveying system are arranged to operate at a same continuously variable processing speed within a range of processing speeds in which the documents are processed at a fixed nominal sheet distance and a fixed nominal document quality, the fixed nominal sheet distance and the fixed nominal document quality being independent of the processing speed, said range of processing speeds including a nominal processing speed, the image reproduction device being arranged for operating continuously at the nominal processing speed; and a control unit that is arranged to select a second processing speed in the range of processing, said second processing speed being higher than the nominal processing speed, maintain the second processing speed for a predetermined time period, adjust the processing speed, during print processing, from a current processing speed to the nominal processing speed upon expiry of the predetermined time period, and determine values for any of the second processing speed and the predetermined time period in advance of a processing job, in dependence on a job setting, timing or page count, and independent of a status of the sheet processing system, thereby performing jobs at a predetermined productivity independent of an actual job size.

2. The device as claimed in claim 1, wherein the control unit is arranged to gradually adjust the processing speed from one processing speed to another processing speed.

3. The device as claimed in claim 1, wherein the control unit is further arranged to switch to a processing speed higher than the nominal processing speed upon:

detecting a high priority job; or detecting an interrupt job that has to be processed while an earlier job is being processed.

4. The device as claimed in claim 1, wherein a job setting include duplex printing, and wherein the control unit is further arranged to select a higher processing speed and adjusts processing timing to be acceptable for the output unit.

5. The device as claimed in claim 1, wherein the control unit is arranged to, after expiry of the predetermined time period, select a third processing speed that is lower than the nominal processing speed, in dependence on operational conditions.

6. The device as claimed in claim 5, wherein said operational conditions comprise an operational parameter, said operational parameter being fuser temperature or available energy supply.

7. The device as claimed in claim 1, further comprising an output unit that delivers processed documents, wherein the control unit is arranged to detect a finishing parameter of the output unit, and to predetermine a higher processing speed, the predetermined time period and a third processing speed after expiry of the predetermined time period in dependence on the finishing parameter.

8. The device as claimed in claim 1, further comprising a scanner unit, wherein the control unit is arranged to execute a scan job at a scan speed in dependence on the selected processing speed.

9. The device as claimed in claim 1, further comprising a plurality of units to control individual elements of the sheet processing system and the document conveying system, wherein the control unit is arranged to determine a sheet position of at least one sheet being conveyed, and communicate commands with the units to control the individual elements at respective operational speeds in dependence on the sheet position.

10. A method of controlling an image reproduction device for document processing, the device comprising an input unit that provides sheets, a document conveying system that conveys the sheets from the input unit to an output unit for receiving processed documents, a sheet processing system that applies an image pattern to a sheet while the sheet is being conveyed from the input unit, past the sheet processing system, to the output unit at a processing speed, said method comprising the steps of:

operating the sheet processing system and all processing elements of the document conveying system device at a same continuously variable processing speed within a range of processing speeds in which the documents are processed at a fixed nominal sheet distance and a fixed nominal document quality, the fixed nominal sheet distance and the fixed nominal document quality being independent of the processing speed, said range of processing speeds including a nominal processing speed, the image reproduction device being arranged for operating continuously at the nominal processing speed;

selecting a second processing speed in the range of processing speeds, said second processing speed being higher than the nominal processing speed;

maintaining the second processing speed for a predetermined time period;

adjusting the processing speed, during print processing, from a current processing speed to the nominal processing speed upon expiry of the predetermined time period; and determining values for any of the second processing speed and the predetermined time period in advance of a processing job, in dependence on a job setting, timing or page count, and independent of a status of the sheet processing system, thereby performing jobs at a predetermined productivity independent of an actual job size.

11. The method as claimed in claim 10, further comprising the step of gradually adjusting the processing speed from one processing speed to another processing speed.

12. The method as claimed in claim 10, further comprising the step of switching the processing speed to a processing speed higher than the nominal speed upon:

detecting a high priority job; or detecting an interrupt job that has to be processed while an earlier job is being processed.

13. The method as claimed in claim 10, further comprising the step of switching the processing speed after expiry of the predetermined time period to a third processing speed lower than the nominal speed in dependence on operational conditions.

14. The method as claimed in claim 10, further comprising the steps of:

controlling individual elements of the sheet processing system and the document conveying system;

determining a sheet position of at least one sheet being conveyed; and communicating commands for operating the individual elements at respective operational speeds in dependence on the sheet position.

* * * * *